US008004936B2

(12) United States Patent
Ruchonnet

(10) Patent No.: US 8,004,936 B2
(45) Date of Patent: Aug. 23, 2011

(54) CLOCK MOVEMENT COMPRISING SELECTABLE INDICATORS

(75) Inventor: Jean-Francois Ruchonnet, Mont-sur-Rolle (CH)

(73) Assignee: Richemont International S.A.

( * ) Notice: Subject to any disclaimer, the term of this patent is extended or adjusted under 35 U.S.C. 154(b) by 69 days.

(21) Appl. No.: 12/032,314

(22) Filed: Feb. 15, 2008
(Under 37 CFR 1.47)

(65) Prior Publication Data

US 2009/0040880 A1 Feb. 12, 2009

Related U.S. Application Data

(63) Continuation of application No. PCT/EP2006/065423, filed on Aug. 17, 2006.

(30) Foreign Application Priority Data

Aug. 17, 2005 (CH) ..... 1342/05

(51) Int. Cl.
*G04B 19/20* (2006.01)

(52) U.S. Cl. ..... 368/77; 368/76; 368/80; 368/233

(58) Field of Classification Search ..... 368/28, 368/35, 37, 76, 77, 80, 106, 185, 190, 198, 368/233
See application file for complete search history.

(56) References Cited

U.S. PATENT DOCUMENTS 3,779,000 A * 12/1973 Schmid ..... 368/38
3,879,929 A * 4/1975 Charbonney et al. ..... 368/38
6,108,278 A * 8/2000 Rochat ..... 368/28

FOREIGN PATENT DOCUMENTS

CH 693155 A5 3/2003
DE 196 49 590 A1 10/1997

OTHER PUBLICATIONS

International Search Report dated Mar. 15, 2007.

* cited by examiner

*Primary Examiner* — Edwin A. Leon
*Assistant Examiner* — Jason Collins
(74) *Attorney, Agent, or Firm* — Blank Rome LLP

(57) ABSTRACT

Watch movement having a display mechanism with: several rotating indicators (12, 15), for displaying a two-digit number in an aperture, cams (5, 6) arranged to control the angular position of the rotating indicator or indicators (12), selection means actuated by the crown (34) for selecting the cam acting on each indicator (12, 15).

20 Claims, 4 Drawing Sheets

CLOCK MOVEMENT COMPRISING SELECTABLE INDICATORS

RELATED APPLICATIONS

The present application is a continuation of international application PCT/EP2006/065423, filed on Aug. 17, 2006, the content of which is hereby incorporated by reference. It claims priority of Swiss patent application CH1342/05, filed Aug. 17, 2005, the content of which is hereby incorporated by reference.

FIELD OF THE INVENTION

The present invention concerns watch movements, in particular a watch movement using cams for determining the position of indicators on the dial.

DESCRIPTION OF RELATED ART

Electronic watches enabling several different functions to be displayed on a numeric display are known. A push-button allows the watch wearer to select the displayed function; each pressing causes the next function in a sequence to be displayed. A large number of different functions can thus be displayed sequentially on a small size dial.

Conventional mechanical watches do not offer this flexibility and in general do not allow a large number of different functions to be displayed. Many mechanical watches thus limit themselves to display the day's date in one aperture, additionally to the time displayed by the hands. Grande date displays, in which the date is displayed by means of two digits borne by two indicators, are also known. When there is sufficient space available, the month, year or day of the week are sometimes also added in another aperture.

Moreover, the indicators (hands or discs) of conventional mechanical watches are generally driven through a gear train comprising a sequence of pinions and wheels. The continuous rotation, always in the same direction, of the gearings does not allow great flexibility in controlling the indicator.

One furthermore also knows watches having a hand driven by a cam. This solution is notably used for retrograde displays. A single cam is associated in fixed fashion to each hand.

BRIEF SUMMARY OF THE INVENTION

One aim of the present invention is to propose a watch movement free from the limitations of the known watch movements.

Another aim of the invention is to propose a watch movement, notably a mechanical movement, allowing the function displayed at a given instant by an indicator to be selected.

According to the invention, these aims are achieved notably by means of a watch movement provided with a display mechanism and having one or several rotating indicators as well as a first cam and a second cam arranged for controlling the angular position of the rotating indicator or indicators. Use of several cams for controlling the position of a single rotating indicator or of a pair of indicators gives great flexibility for controlling the indicators.

The watch movement also preferably includes selecting means for selecting the cam acting on each indicator. These selection means can for example be actuated by the crown to choose at any time the cam whose position determines the value displayed by the indicator.

In a preferred embodiment, the movement has a tens indicator and a units indicator, for example in the form of discs that together make it possible to display a two-digit number in a double aperture to be displayed. The movement further comprises several pairs of cams and means for selecting at any time the pair of cams controlling the pair of indicators. Each pair corresponds to a different function displayed.

By way of example, the movement of the invention can display freely one of the following indications in an aperture:

The date of the day (from 1 to 31; function 1)
The month (from 1 to 12; function 2)
The year of revision (from 1 to 9, for example; function 3)
The amount of power reserve (from 1 to 48, depending on the watch; function 4)
The week (from 1 to 53)
The current year (from 00 to 99)
Etc.

The function displayed is selected by the watch wearer, for example by means of the crown. Each action on the crown allows the next function in a sequence to be selected. The selected indication is then displayed by pressing on a push-button that makes it possible to act on feeler-spindles (fingers) whose position is determined by the shape and the angular position of cams made to rotate by a gearing adapted to each function.

In one example, the units cam has 60 teeth and that of the tens is reduced by a factor of 10, i.e. 6 teeth. This configuration allows values from 0 to 59 to be displayed. Units cams with 100 teeth and tens cams with 10 teeth can also be used for displays from 0 to 99.

Once the selection has been performed, the feeler-spindles (fingers) of the units and of the tens come to be positioned against the corresponding cam and through a level (amplifying lever) move a rack that engages a pinion to index the corresponding disc and display the information.

BRIEF DESCRIPTION OF THE DRAWINGS

Examples of embodiments of the invention are indicated in the description illustrated by the attached figures, in which.

EXAMPLES OF EMBODIMENTS OF THE INVENTION

Figure 1:
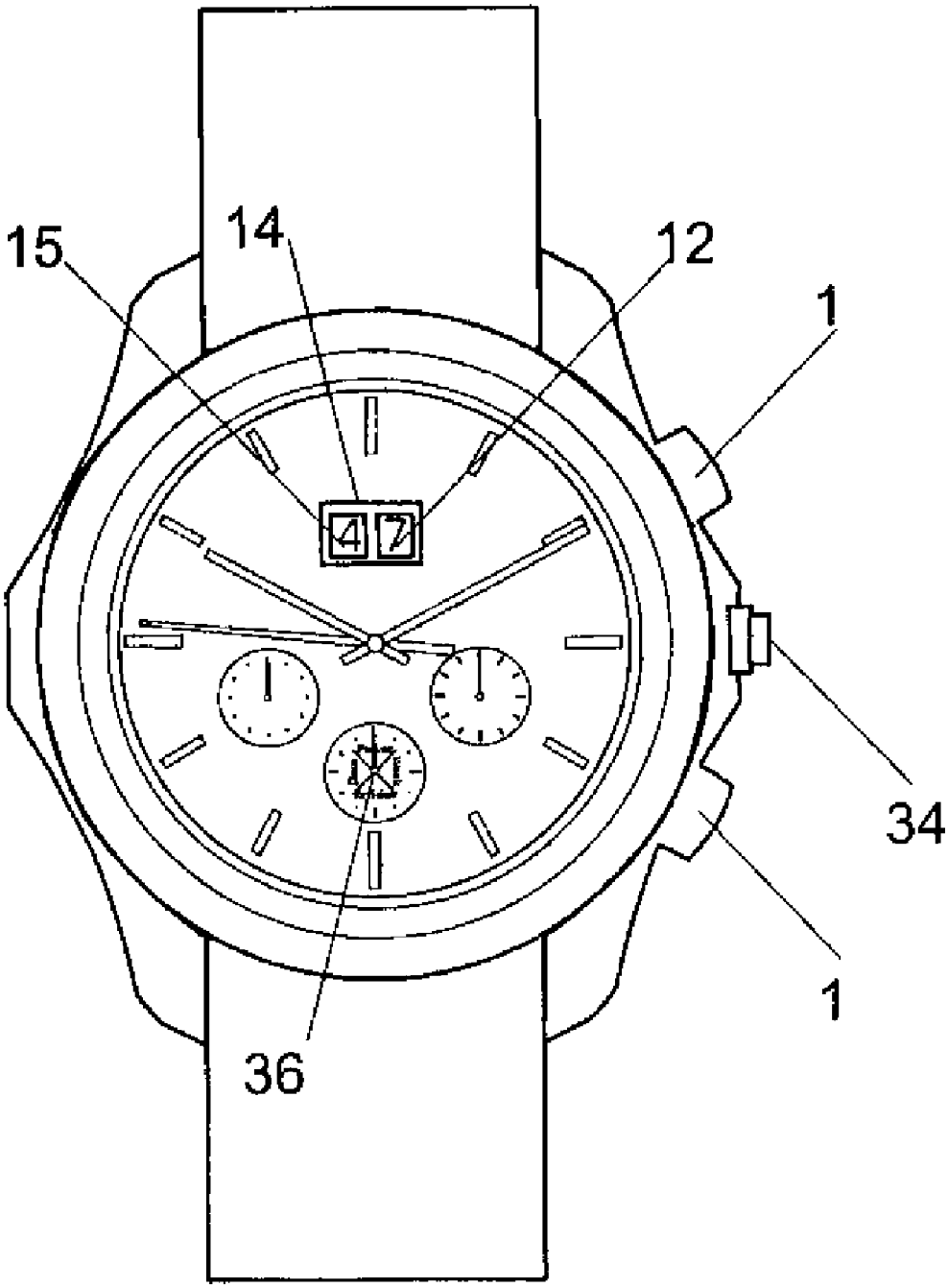
FIG. 1 shows a perspective view of a watch having a movement according to the invention.

FIG. 1 illustrates a perspective view of a watch provided with a mechanical movement according to the invention. The watch has hands at the center for displaying the hours, minutes and seconds in an entirely conventional manner, as well as, in this embodiment, small dials for displaying auxiliary indications, for example chronometer-measured durations. An aperture 14 enables a two-digit numerical indication borne by a tens disc 15 and by a units disc 12 to be displayed. The type of indication displayed at any given instant is selected by means of the crown 34 or, in one embodiment, by means of one of the push-buttons 1. The choice made is further indicated by a hand 36 on a small dial at 6 o'clock. The desired indication can be displayed permanently or only when the watch wearer presses on one of the push-buttons 1.

In this example, the indication displayed in the aperture 14 corresponds to a power reserve; the watch illustrated also allows the week, the year of revision or the date to be displayed in the same aperture. Other selectable functions can be displayed. Furthermore, the invention is not limited to indicators 12, 15 constituted by discs displaying a value in an aperture; hands can also be controlled according to the same principle.

Figure 2:
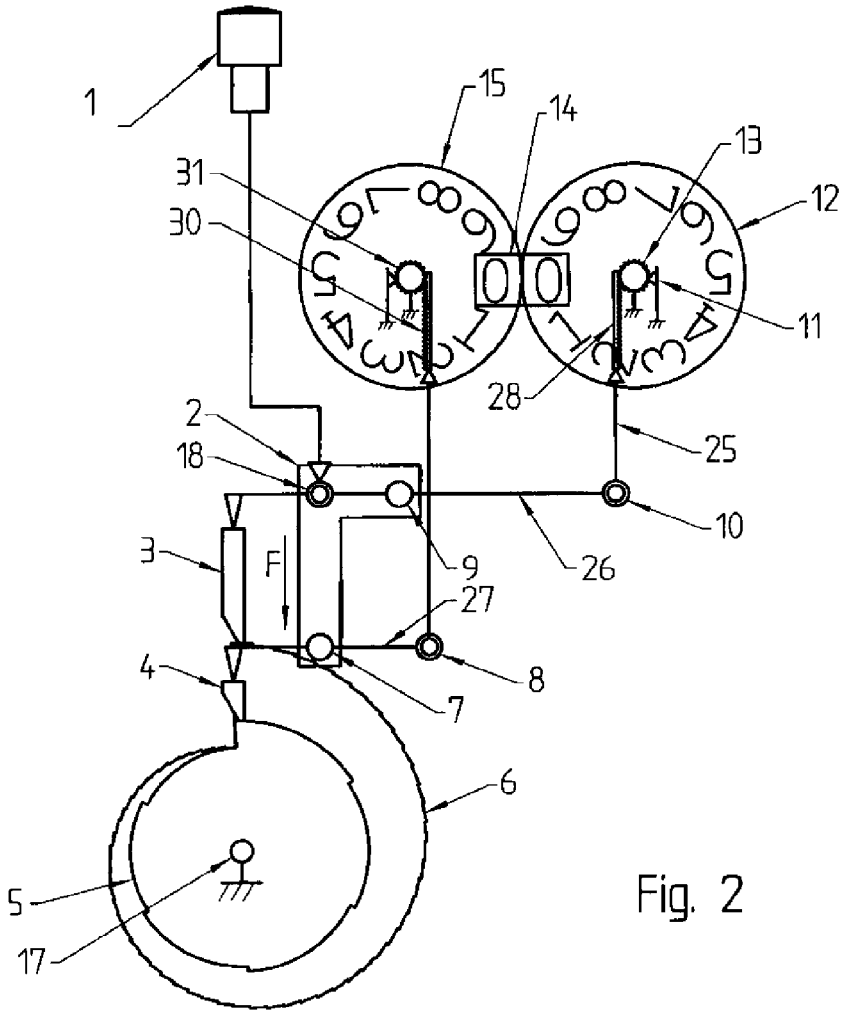
FIG. 2 illustrates diagrammatically the watch movement of the invention.
Figure 3:
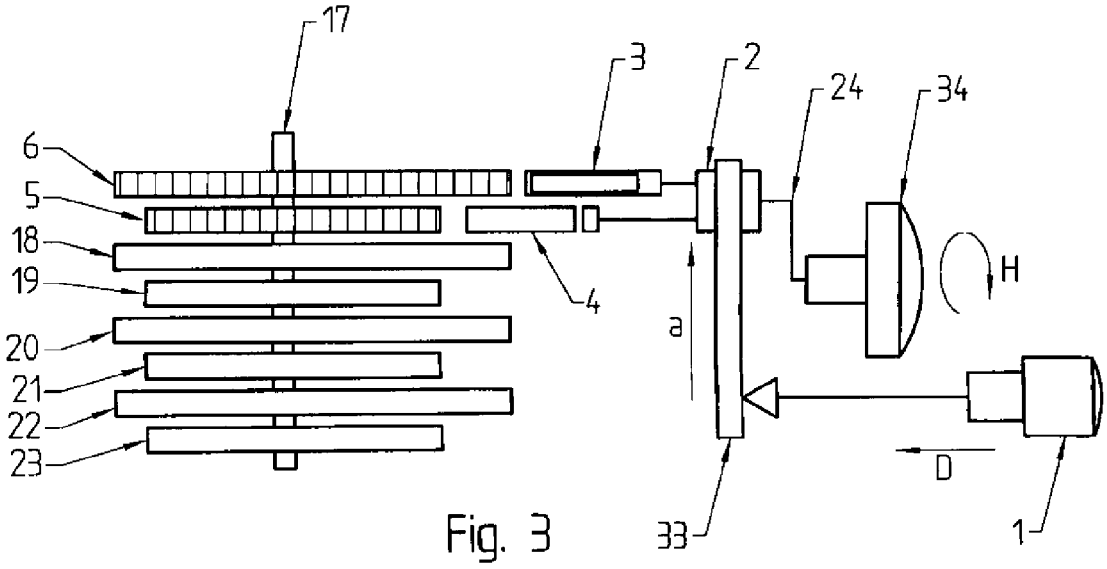
FIG. 3 is an elevated view of the movement of FIG. 2.
Figure 6:
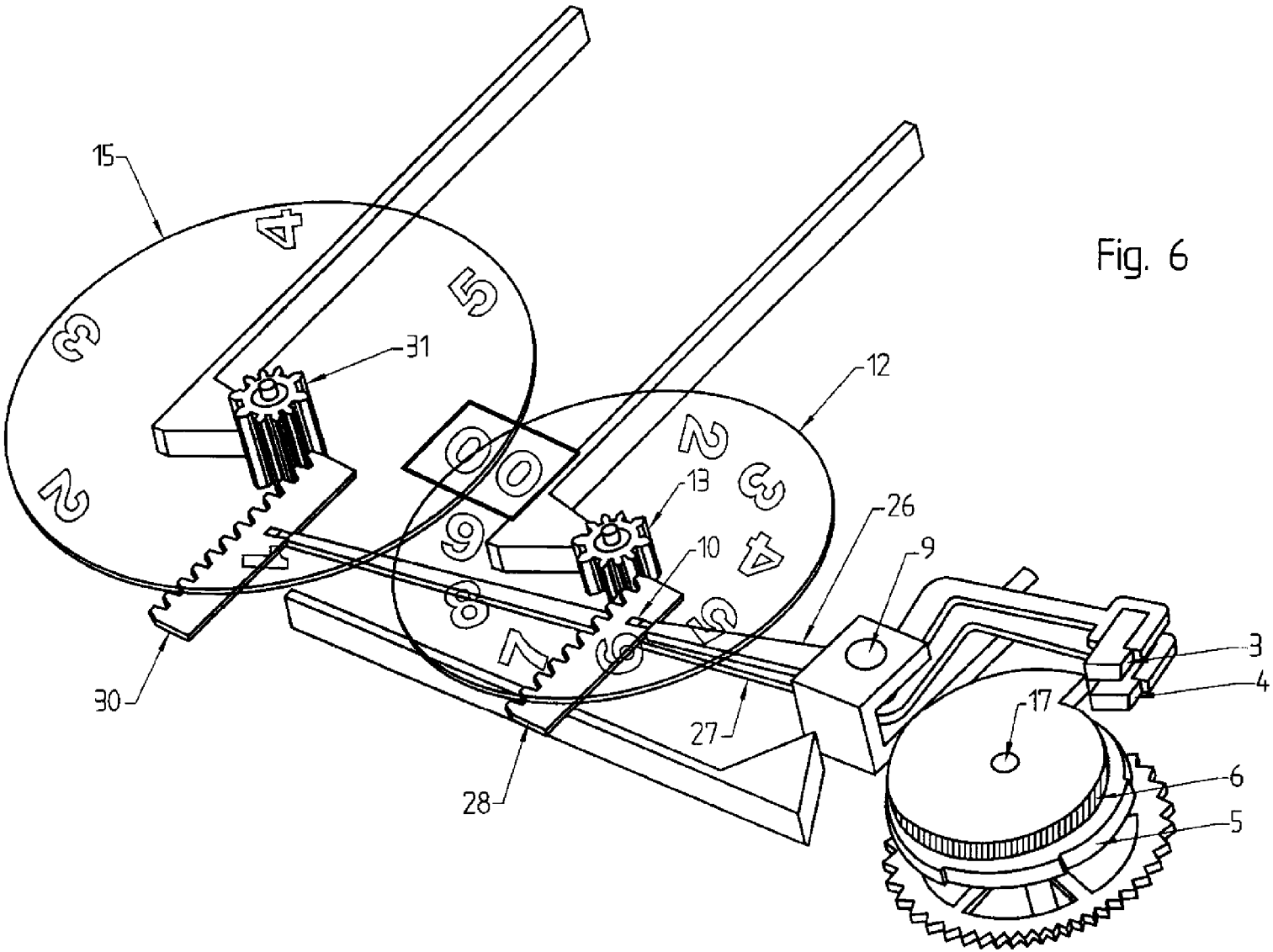
FIG. 6 is a simplified perspective view of the movement's elements useful for understanding the invention.

We will now describe the principle of the inventive mechanism while referring simultaneously to FIGS. 2, 3 and 6. The movement comprises at least two cams, including a units cam 6 and a tens cam 5 made to rotate by a gear train, not represented. In this example, the units cam has 60 teeth and the tens cam 6 teeth. Both cams are mounted coaxially on the staff 17 and turn in synchronous fashion in clockwise direction. The speed of rotation, given by the gear train, can depend on the selected function.

Fingers (or feeler-spindles) 3 respectively 4 rest against the side of the cam 6 respectively 5. The fingers move along the direction of arrow F (FIG. 1) according to the height of the tooth with which they are in contact. The position of the fingers thus depends on the profile and on the angular position of the corresponding cam.

The fingers 3, 4 are made to press against the corresponding cam 6 respectively 5 by means of the selector 2 exerting a pressure in the direction of arrow F when the push-button 1 is actuated. It is also conceivable to use fingers permanently in contact with the corresponding cam, for example under the action of a spring.

The finger 3 is pressed against the associated cam 6 by making the lever 26 pivot around the staff 9. The extremity of the lever 26 opposite the finger 3 is provided with an articulation 10 engaged in a rack 28. On FIG. 1, the connection between the lever 26 and the rack 28 is made through an arm 25, optional and not represented in FIG. 6. The pivoting of the lever 26 under the action of the cam 6 causes a longitudinal displacement of the rack 28, which causes a rotation of the pinion 13 to which the units disc 12 is associated. The position of the units disc 12 is thus given by the profile and the angular position of the associated cam 6. The shape and the pitch of the teeth on this cam are determined so that each time the finger 3 passes from one tooth to the next, this causes a net indexation movement of the associated disc, which thus can only occupy a limited number of discrete angular positions.

In the same manner, the tens cam 5 driven in rotation at the same speed as the units cam causes the indexation of the tens disc 15. The transmission occurs through the tens finger 4, of the lever 27, of the rack 30—which can be connected to an arm 29—and of the pinion 31.

In the illustrated example with a tens cam 5 having 6 teeth and a units cam 6 having 60 teeth, the tens disc is incremented as soon as the tens disc has performed one turn plus one step (to pass from 0 to 10). The finger 4 resting on the tens cam thus passes onto the second tooth as soon as the tens cam 5 has traveled 66°.

The movement illustrated notably in FIG. 3 has 4 pairs of cams, i.e. 4 units cams and 4 tens cams making it possible to display 4 functions. The function 1 is given by the cams 6-5, the function 2 by the cams 18-19, the function 3 by the cams 20-21 and the function 4 by the cams 22-23. Other numbers of cam pairs can be used within the frame of the invention.

In the illustrated example, all the cams are superimposed and mounted coaxially on a staff 17. The cams thus turn in synchronous fashion by being driven by the staff 17. Juxtaposed cams can however also be used to reduce the thickness of the superposition. Furthermore, it is also possible to use cams or cam pairs turning at different speeds or even in different directions. It is possible to use units cams and tens cams that are all identical but that turn at different speeds and/or that are phase-shifted. It is also possible to use cam pairs having different profiles. Furthermore, it is also possible to use cams turning in non-continuous manner or with a variable angular speed.

One of the cam pairs is selected to display one of the four functions in the aperture by displacing the units fingers and the tens fingers along the column 33, along the arrow B. The displacement of the fingers 3, 4 is actuated through the selector 2 through the crank-handle or crank-pin 24 fixedly united with the crown 34 turning in the direction of arrow H. Other selection means, for example by means of a push-button or depending on predefined events of the watch can be conceived.

Once the position has been defined and a pair of cams has been selected, it is sufficient to press on the push-button 1 in the direction of arrow D to displace the entire column 33 and feel the two selected cams with the fingers 3, 4 in order to determine the value displayed in the aperture 14.

Figure 4:
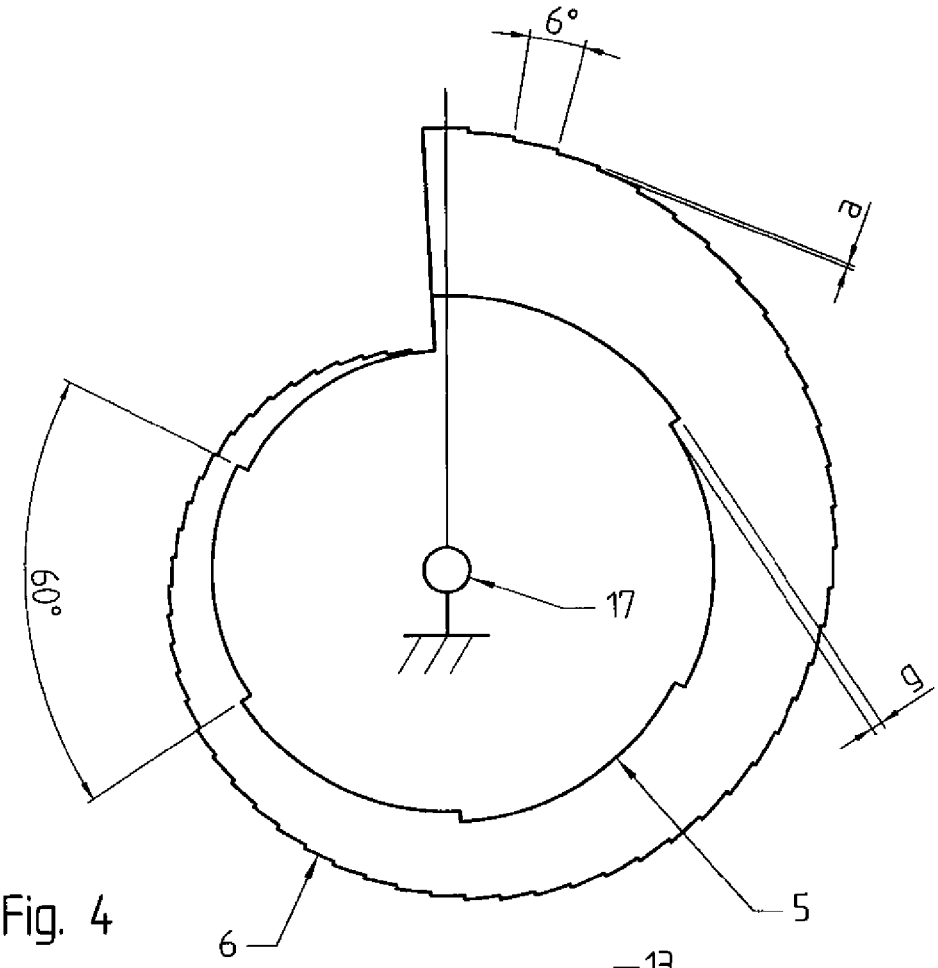
FIG. 4 illustrates a pair of cams used in the movement.

A pair of cams 5-6 is illustrated by way of example in FIG. 4. One sees the units cam 6 whose external profile is provided in this example with 60 teeth spaced angularly by 6°; the height of each tooth is indicated by the reference a. The snail-like shape of the cam causes the associated rack to move in one direction at each incrementing step, then a sudden return in the other direction after a complete turn of the cam. Other profiles, requiring more back-and-forth movements, can be conceived.

The tens cam 5 is provided in this example with 6 teeth spaced angularly by 60° with a height g. As for the cam 6, the associated rack travels in this non-limiting example a linear displacement in one direction at each turn of the cam, then a quick return to the initial position.

Both cams are assembled on the staff 17 allowing an angular articulation but making the cams united in rotation. The staff 17 (or each cam individually) is made to turn by a gear train, not represented.

Figure 5:
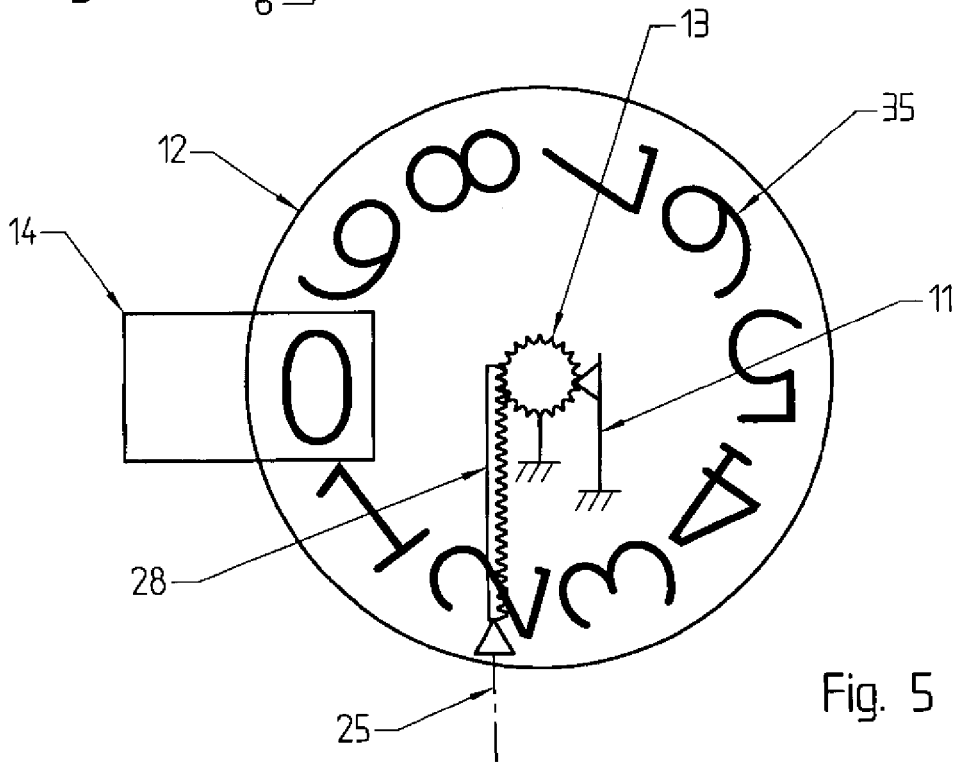
FIG. 5 illustrates the units disc of the movement.

FIG. 5 shows the units disc 12 provided with digits from 0 to 9 corresponding to 10 angular positions of the units cam. The units disc performs a complete turn in clockwise direction when the units cam is incremented by 10 positions, i.e. by 60°. After 6 complete turns, in this example, the rack 28 takes up again its initial position and the disc 12 performs 6 turns in anti-clockwise direction. A spring 11, cone-shaped in this example, momentarily blocks the position of the pinion 13 associated to the indicator in order to ensure an exact position of the digits 35 in the aperture 14. A mechanism for liberating the spring 11 during the rack's displacement is not described here.

The tens disc is made in a similar manner, only the indications marked 35 being possibly different. In the embodiment of FIG. 6, designed to display numbers up to 59 at most, only the digits from 0 to 6 are marked on the tens disc.

As mentioned, the units disc or discs 12 are connected to the corresponding units cam 6 through the lever 26 pivoting around the staff 9. The tens disc or discs are connected to the tens cam 5 through the lever 27 pivoting around the same staff 9. It is however possible to vary the shape and dimension of the levers 26, 27 and/or the position of the pivot point 9 in order to vary the amplification ratio of the levers 26, 27 and thus produce angular displacements of the different indicators for a given tooth height a, g.

The above embodiment concerns a display of functions through an aperture, by means of a tens disc and of a units disc. The discs can however also be replaced by hands. Furthermore, non-decimal displays can also be used, for example to display seconds or minutes from 0 to 59 or hours from 0 to 11 or from 0 to 23. The invention also applies to movements having a single indicator, for example a single disc, and several cams of which one can be selected by means of an organ to display the chosen function.

The different cams or cam pairs can be driven at different speeds, through independent gear trains, according to the indication one wishes to display. It is thus possible to have several functions with a single cam or cam pairs by selecting the gear train used for determining the position of this cam. Furthermore, it is also possible to design a watch that always displays by default the same function in the aperture, for example the date, and a different function only when a selector organ 34 is actuated.

In the illustrated embodiment, an indication is displayed in the aperture only when the push-button 1 is pressed. It is however also possible to press the fingers 3, 4 against the selected pair of cams even when the push-button is not selected and to disengage these fingers for example when the function is changed. This variant embodiment has the advantage of displaying at all times a function, for example the selected function or the default function in the aperture 14.

LIST OF THE ELEMENTS ILLUSTRATED BY WAY OF EXAMPLE ON THE FIGURES

1 Push button 1
2 Selector
3 Units finger
4 Tens finger
5 Tens cam 1
6 Units cam 1
7 Staff of the articulated arm 27 of the tens
9 Staff of the articulated arm 26 of the units
10 Articulation arm 26-rack
11 Cone-shaped spring
12 Units disc
13 Units pinion
14 Aperture
15 Tens disc
17 Staff bearing all the cams
18 Tens cam 2
19 Units cam 2
20 Tens cam 3
21 Units cam 3
22 Tens cam 4
23 Units cam 4
24 Crank-handle for controlling the position of the fingers along the column 33
25 Units arm
26 Units lever
27 Tens lever
28 Units rack
29 Tens arm
30 Tens rack
31 Tens pinion
33 Column
34 Crown
35 Digits on the units disc
36 Display of the function
a Height of the teeth of cam 6
g Height of the teeth of cam 5
B Direction of displacement along the column 33
D Direction of displacement of the push button 1
F Direction of displacement of the fingers against the cams
H Direction of rotation of the crown

The invention claimed is:

1. Watch movement having a multi-function display mechanism comprising:

at least one rotating indicator, wherein for each rotating indicator the display mechanism comprises:

at least a first cam associated with a display of a first function and a second cam associated with a display of a second function, each cam being selectable to control the angular position of the rotating indicator independently of any other cam; and a selector for, depending on the function to be displayed, selecting one of said cams to control the position of the rotating indicator.

2. The movement of claim 1, having:

several pairs of cams, a units indicator, a tens indicator, said selector being adapted to select cam pair determining the angular position of said tens and units indicators at a given instant.

3. The movement of claim 2, wherein said cam pairs are superimposed.

4. The movement of claim 3, wherein said cam pairs all turn at the same angular speed.

5. The movement of claim 1, further comprising an indicator to indicate on the dial the selected cam or cam pair.

6. The movement of claim 1, further comprising a selector for selecting a gear train used for driving one of said cams.

7. The movement of claim 1, having:

a pair of fingers, each finger being associated to one cam in one of said cam pairs for feeling the external profile of the cams, a lever associated to each finger, each lever pivoting around a pivot staff when the corresponding finger moves under the effect of the cam's rotation so as to drive a rack, wherein the pivot staffs of the different levers are non-coaxial so as to control the amplification of the rotations of said indicators caused by a given tooth height on said external profile.

8. The movement of claim 1, further comprising a rotating units indicator controlled by a first cam and a rotating tens indicator controlled by said second cam, said units indicator and said tens indicator displaying together a two-digit number.

9. The movement of claim 1, wherein at least one cam is made to rotate by actuating the associated indicator through a rack and a pinion.

10. The movement of claim 1, wherein:

each of said at least first cam and the second cam has an external profile with a distance to the center varying along its periphery, and for each of said indicators the display mechanism comprises, a finger for feeling the external profile of the cam selected to act on this indicator, a lever associated to said finger, a rack actuated by said lever, a pinion made to rotate by said rack;

a indicator being driven by said pinion.

11. The movement of claim 10, said display mechanism being multifunctional, each of said indicator being a disc bearing digits designed to be displayed in an aperture, and wherein said finger can be pressed against said selected cam acting on a push-button.

12. The movement of claim 1, the second cam being driven in synchronous fashion with said first cam, the external profile of said first cam comprising teeth spaced by a first pitch, the profile of said second cam comprising teeth spaced by a second pitch, said second pitch being a multiple by 10 of said first pitch, so as to cause an increment of a tens indicator after ten increments of a units indicator.

13. The movement of claim 1, the first cam and the second cam being mounted coaxially.

14. The movement of claim 1, adapted for a wristwatch.

15. A watch having a multi-function display mechanism comprising at least one rotating indicator, wherein for each rotating indicator, the watch comprises:

a first cam associated with the display of a first function and a second cam associated with the display of a second function, each cam being selectable to control the angular position of the rotating indicator independently of the other cam, a selector for, depending on the function to be displayed, selecting one of the first cam and the second cam to control the position of the indicator, a push-button or a crown for operation of the selector.

16. A watch comprising:

at least one rotating indicator, a first cam associated with a display of a first function and a second cam associated with a display of a second function, each cam being selectable to control the angular position of the at least one rotating indicator independently of the other cam, selecting means for, depending on the function to be displayed, selecting one of said first and second cam to control the position of the indicator.

17. A watch movement having a multi-function display mechanism comprising:

at least one rotating indicator, a cam arranged to control the angular position of each rotating indicator, a plurality of gear trains, each gear train being associated with a display of a different function and each gear train being selectable to control the angular position of the cam independently of the other gear trains, and a selector for, depending on the function to be displayed, selecting the gear train used for determining the position of the cam.

18. The movement of claim 17, said selector being actuated by means of a push-button or a crown that can be operated by the watch wearer.

19. The movement of claim 18, said crown actuating a crank-handle or crank-pin for displacing a feeler finger of said at least the first cam and the second cam.

20. A watch movement having a multi-function display mechanism comprising:

at least one rotating indicator, a pair of cams arranged to control the angular position of each rotating indicator, a plurality of gear trains, each gear train being associated with a display of a different function and each gear train being selectable to control the angular position of at least one of the cams in the pair of cams independently of the other gear trains, and a selector for, depending on the function to be displayed, selecting the gear train used for determining the position of at least one of the cam in the pair of cams.

* * * * *